US005183189A

United States Patent [19]

Baudin

[11] Patent Number: 5,183,189

[45] Date of Patent: Feb. 2, 1993

[54] CONTROL VALUE FOR A CONTAINER CONTAINING A FLUID UNDER GASEOUS PRESSURE AND CONTAINER PROVIDED WITH A VALUE OF THIS KIND

[75] Inventor: Gilles Baudin, Clichy, France

[73] Assignee: L'Oreal, Paris, France

[21] Appl. No.: 770,406

[22] Filed: Oct. 3, 1991

[30] Foreign Application Priority Data

Nov. 9, 1990 [FR] France ..... 90 13916

[51] Int. Cl.[5] ..... B65D 83/70

[52] U.S. Cl. ..... 222/397; 222/402.24

[58] Field of Search ..... 222/396, 397, 402.1, 222/402.24

[56] References Cited

U.S. PATENT DOCUMENTS

| | | | |
|---|---|---|---|
| 3,005,577 | 10/1961 | Webster | 222/397 |
| 3,081,919 | 3/1963 | Samuel | 222/396 |
| 3,180,374 | 4/1965 | Muller | 222/396 X |
| 3,519,172 | 7/1970 | Bruce | 222/396 |
| 3,664,557 | 5/1972 | Bruce | 222/397 |
| 3,666,148 | 5/1972 | Webster | 222/396 |
| 3,870,203 | 3/1975 | Frankenberg | 222/397 |
| 4,030,644 | 6/1977 | Creighton | 222/396 |

FOREIGN PATENT DOCUMENTS

| | | |
|---|---|---|
| 2059787 | 4/1971 | France . |
| 918147 | 2/1963 | United Kingdom . |

*Primary Examiner*—Kevin P. Shaver
*Assistant Examiner*—Kenneth Bomberg
*Attorney, Agent, or Firm*—Cushman, Darby & Cushman

[57] ABSTRACT

The control valve comprises a valve stem (6) movable in a valve body (3), this stem being provided axially with two opposing recessed channels (7, 8) each leading to one end of the stem (6) and separated by a base (9), two transverse orifices (10, 11) being provided in the lateral wall of the stem on either side of the base (9), each orifice communicating respectively with a channel, a sealing member (12) held in the valve body and traversed by the stem (6), a first spring (13) adapted to force the stem (6), relative to the valve body (3), in a direction corresponding to an outward movement by the stem, and a second spring (20) disposed so as to prevent outward movement by the stem (6) as long as the pressure in the interior of the container does not exceed a predetermined value. The two springs (13, 20) are disposed in parallel, one end of the first spring (13) and of the second spring (20) resting against a means (14) stopped by a unilateral stop (15) of the stem, wherein this means (14) can slide relative to the stem (6) in the event of outward movement by the latter, and the second end of the first spring (13) resting against a stop (17) integral with the valve body (3), while the second end of the second spring (20) rests against a stop (21) integral with the stem (6).

11 Claims, 3 Drawing Sheets

CONTROL VALUE FOR A CONTAINER CONTAINING A FLUID UNDER GASEOUS PRESSURE AND CONTAINER PROVIDED WITH A VALUE OF THIS KIND

BACKGROUND OF THE INVENTION

The invention relates to a control valve for a container containing a fluid under gaseous pressure, especially for an aerosol can, of the type comprising:

- a valve stem movable in a valve body, this stem being provided axially with two opposing recessed channels each leading to one end of the stem and separated by a base, two transverse orifices being provided in the lateral wall of the stem on either side of the base, each orifice communicating respectively with a channel, the channel remote from the valve body and the associated transverse orifice forming a dispensing passageway, the other channel and the associated transverse orifice forming an evacuation passageway;
- a sealing member held in the valve body and traversed by the stem;
- a first spring adapted to force the stem, relative to the valve body, in a direction corresponding to an outward movement by the stem;
- and a second spring disposed so as to prevent outward movement by the stem as long as the pressure in the interior of the container does not exceed a predetermined value, the whole assembly being such that by pressing the stem, the user brings the dispensing passageway into communication with the interior of the valve body, resulting in dispensing of the product and that, in the event of abnormal excess pressure, the second spring is compressed and the stem is raised, bringing the evacuation passageway to atmospheric pressure and preventing the container from exploding.

A valve of this type is described, e.g. in FR-A-2 059 787. This valve has relatively large axial dimensions and the two springs are not truly independent, so that a change in the adjustment of one may lead to a change in the adjustment of the other.

The object of the invention is above all to provide a valve of the type defined hereinbefore which no longer has, or displays to a lesser extent, the disadvantages described hereinabove.

SUMMARY OF THE INVENTION

According to the invention, a control valve for a container containing a fluid under gaseous pressure, especially for an aerosol can, of the type defined hereinbefore is characterized in that the two springs are disposed in parallel, that one end of the first spring and of the second spring rests against a means stopped by a unilateral stop of the stem, wherein this means can slide relative to the stem in the event of outward movement of the latter, and that the second end of the first spring rests against a stop integral with the valve body, while the second end of the second spring rests against a stop integral with the stem.

By virtue of an arrangement of this kind, the valve is relatively compact and the independence of the springs makes it possible to adjust the levels of intervention of each spring with precision, without one affecting the other.

The first and second springs are advantageously helical springs disposed concentrically. The first spring which operates during dispensing is exterior to the second spring and its length is greater than that of the second spring, which operates for evacuation in the event of abnormal excess pressure.

The support means advantageously consists of a rigid washer comprising a radial shoulder projecting towards the interior over its inner diameter and adapted to cooperate with an outer radial shoulder of the stem.

The arrangement of the transverse orifices of the stem is advantageously such that when the stem is at rest, the transverse orifice opening into the evacuation channel is situated on the same side of the sealing member as the valve body, while the other transverse orifice of the dispensing channel is closed on the outside by the said sealing member.

This sealing member may consist of a washer of elastomeric material or the like, held in the vicinity of its outer periphery between the upper edge of the valve body and a cup provided in the upper part of the container.

The stop integral with the valve body, serving as a support for the first spring, consists of a shoulder projecting radially towards the interior of the valve body.

According to a preferred embodiment, when the container comprises a dip tube integral with the valve body and opening into the latter, the valve is adapted, in the event of abnormal excess pressure, to allow for evacuation to the exterior of the gas causing the excess pressure and for the liquid fraction to remain in the interior of the container.

To this end, the lower part of the valve stem is adapted to stop communication between a tube fitting to a dip tube and the evacuation passageway when the stem is raised on account of excess internal pressure in the can, while an additional gas inlet is provided in the valve body above the sealing zone between the valve stem and the body in order to maintain the communication between the evacuation passageway and the upper part of the container and to allow for evacuation of the gas alone.

The lower end of the valve stem is advantageously provided with an O-ring, while a truncated passageway, the diameter of which decreases in the direction of outward movement of the stem, is provided in the valve body, the end of the stem provided with the O-ring being displaced in this passageway which it closes in the upper part when the stem is raised, the recessed channel of the stem directed towards the valve body communicating laterally with the inner volume of the valve body.

The end of the stem preferably consists of an added member comprising a transverse channel and fixed, inter alia by screwing, to the part of the stem to which the recessed channel leads, the radial shoulder formed by the excessive thickness of this member added to the stem forming the stop for the second spring which operates in the event of evacuation.

The invention also relates to a container, especially an aerosol can under gaseous pressure, provided with a valve of the type defined hereinbefore.

In addition to the arrangements described hereinabove, the invention also consists of a number of other arrangements which will be described in more detail hereinafter by way of non-limiting embodiments described with reference to the accompanying drawings, in which:

DETAILED DESCRIPTION OF THE INVENTION

Before describing the actual valve, it should be recalled that a compressed gas contained under high pressure in a cartridge provided with a pressure reducing valve can be used as an aerosol propellant. As a non-limiting guide, the cartridge may have a volume of approximately 20 ml and the gas may be under a pressure of 40 to 90 bar in a full cartridge. If necessary, during use the pressure reducing valve delivers a quantity of gas at low pressure, of approximately 2 to 5 bar, determined so that the pressure in the interior of the aerosol can remains constant.

If for some reason this cartridge explodes or bursts it will instantaneously release the compressed gas at high pressure it contains. This will result in excess pressure in the interior of the aerosol can, which, in some cases, may cause the container to explode.

Similarly, it is conceivable, depending on the preparation and the propellant used, that a sharp increase in temperature of the aerosol container may cause an internal pressure that the aerosol container cannot withstand, resulting in explosion thereof.

Safety valves have already been proposed, which, in the event of a problem, release the contents of the container into the atmosphere in order to prevent explosion.

The object of the invention is to provide a valve of this type which is particularly compact and makes it possible to adjust with precision the different pressure levels for dispensing and evacuation.

Figure 1:
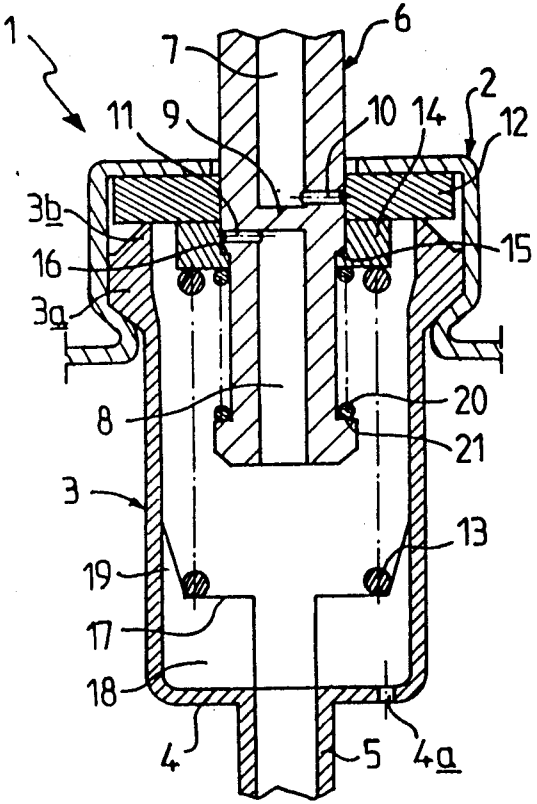
FIG. 1 is a vertical axial section, with broken away portions, of a valve according to the invention, the stem being at rest in the closed position.
Figure 7:
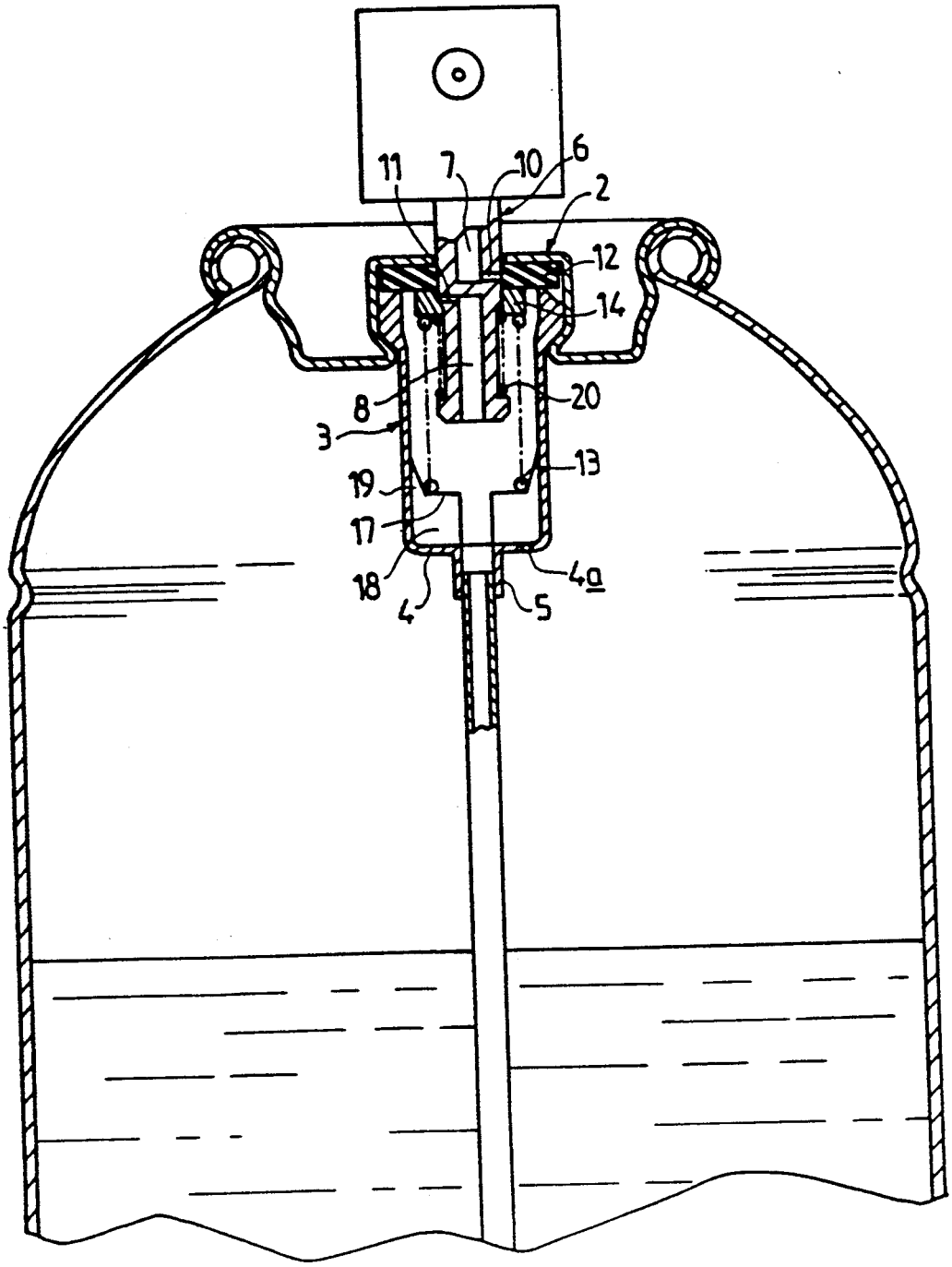
FIG. 7 is a view in elevation, partly in section of the valve of the present invention installed on a container.

Referring to FIG. 1, it shows a control valve 1 for a container (see FIG. 7), provided with a cup 2 in which the body 3 of the valve is crimped. This valve body 3 has a cylindrical shape and is open in its upper part. It comprises on its outer periphery, in the vicinity of its upper end, a bulge 3*a* for the crimp, while its upper edge 3*b* forms a sort of circular stop so that pressure can be exerted on a reduced surface. The lower part of the body 3 consists of a base 4 provided with a tube fitting 5 adapted to be connected to a dip tube (not shown) extending as far as the base of the container to remove a liquid to be sprayed in aerosol form therefrom The valve 1 comprises a valve stem 6 movable in the body 3 in an axial movement of translation, the stem 6 being coaxial with the body 3.

This stem 6 is provided axially with two recessed channels 7, 8 aligned with and opposite one another, each leading to one end of the stem. The channel 7 or dispensing channel furthest from the base 4 of the valve body opens into the atmosphere, while the other channel 8 opens into the valve body 3. The two channels 7, 8 are separated by a transverse base 9 which may be provided substantially half-way along the stem 6.

Two transverse orifices 10, 11 opening respectively into the channels 7, 8 are provided in the lateral wall of the stem axially on either side of the base 9. These orifices 10, 11 may be offset angularly by 180°, as illustrated in FIG. 1.

The first channel 7 and the associated transverse orifice 10 form a dispensing passageway serving for the normal dispensing of the aerosol. The other channel 8 and the associated transverse orifice 11 form an evacuation passageway in the event of abnormal excess pressure.

A sealing member 12 formed by a washer of flexible material, inter alia elastomeric material, is held on the open end of the valve body. The washer 12 is held against the rim 3*b* of the valve body by a flanged part of the cup 2. The inner diameter of the washer 12 presses in a sealed manner against the outer surface of the stem 6 which can slide into this washer.

A first helical spring 13, coaxial with the body 3, is adapted to force the stem 6 in a direction corresponding to an outward movement by the stem.

This spring 13 rests at its end remote from the base 4 against a means 14 consisting of a rigid washer, stopped by a unilateral stop 15 of the stem 6. This stop 15 is formed by a shoulder formed at a decrease in the outer diameter of the stem 6. The rigid washer 14 comprises a radial shoulder 16 projecting towards the interior over its inner diameter, adapted to cooperate with the outer radial shoulder 15 of the stem.

At its other end, the spring 13 rests against a stop 17 integral with the valve body 3. This stop 17 consists of shoulders 18 projecting radially towards the interior of the valve body 3 and distributed at regular angular intervals. The upper outer edges 19 of the shoulders 18 widen towards the stem 6 so as to ensure good centering of the lower end of the spring 13.

An additional gas inlet 4*a* consisting of an orifice is provided in the base 4 of the body 3 between two shoulders 18.

A second helical spring 20 is disposed concentrically to the spring 13 in the interior of the latter, the diameter of this spring 20 being less than that of the spring 13. The length of the spring 20 is less than that of the spring 13.

The upper end of the spring 20 also rests against the washer 14. The second end of this spring 20 rests against a stop 21 integral with the stem 6. This stop 21 is advantageously formed by a shoulder projecting radially towards the exterior over the surface of the stem 6 having the smallest diameter, in the vicinity of its lower end.

The whole assembly is adapted so that in the rest position of the stem 6, the transverse orifice 10 opens externally at the sealing washer 12 which closes this orifice, while the transverse orifice 11 is situated below this washer 12 and opens into the body 3.

The operation of the valve of FIG. 1 is as follows.

Figure 2:
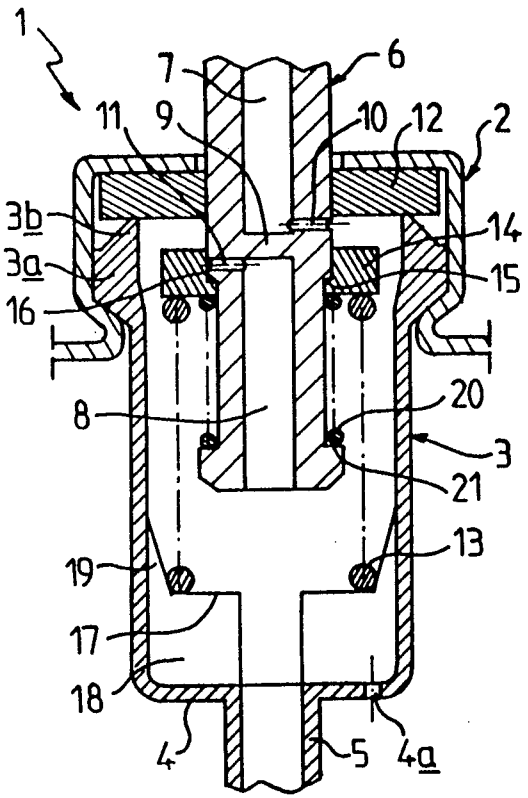
FIG. 2 in a similar manner to that of FIG. 1, shows the valve when the stem is pressed by a user and occupies the dispensing position.

When the user wishes to spray the product contained in the container in aerosol form, he exerts pressure towards the bottom of the stem 6, generally by means of a head (not shown) mounted on the stem 6. The latter is pressed, sliding into the washer 12, as illustrated in FIG. 2. The support means 14 is moved by the stem 6 and pushes only the spring 13. The spring 20 is displaced with the stem 6 and does not operate.

The transverse orifice 10 is then in communication with the inner volume of the body 3 and, under the action of the internal pressure of the container, the product contained in this container is dispensed through the orifice 10 and the dispensing channel 7 in order to form an aerosol sprayed to the exterior.

When the user stops pressing on the stem 6, the latter resumes its closed position of FIG. 1.

In the event of abnormal excess pressure in the interior of the container, this excess pressure is transmitted to the interior of the body 3 and acts on the valve stem 6 against only the spring 20.

Figure 3:
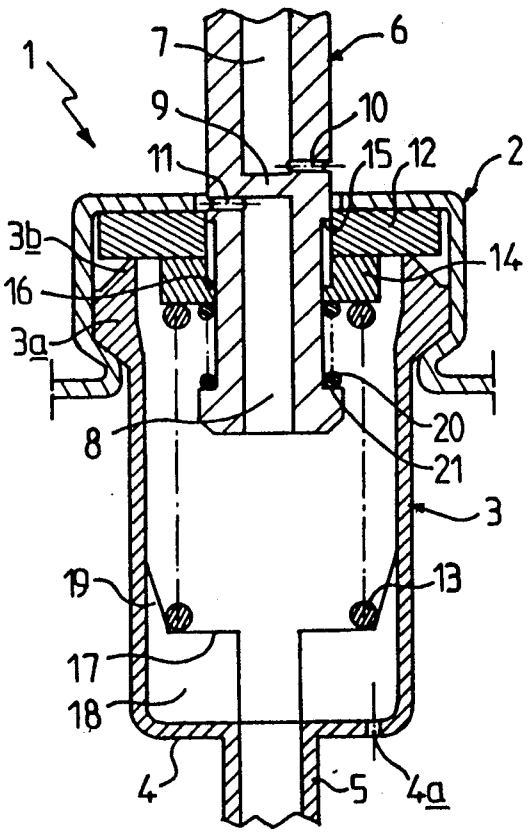
FIG. 3 in a similar manner to that of FIG. 1, shows the valve when the stem is moved out and occupies an evacuation position as a result of abnormal excess pressure in the container.

When this excess pressure reaches a predetermined value, depending on the adjustment of the spring 20, the latter is compressed, the means 14 still resting against the washer 12, as illustrated in FIG. 3.

The stem 6 comes further out of the body 3. When the transverse orifice 11 has traversed the sealing washer 12 it comes into communication with the atmosphere allowing the fluid to escape to the atmosphere through the evacuation channel 8 and the orifice 11 until the pressure in the interior of the container returns to an acceptable value. The stem 6 then resumes the position of FIG. 1.

The valve shown in FIGS. 1 to 3 therefore offers a guarantee against explosion, although it is still unpleasant to see all or part of the liquid contained in the container, and in which the dip tube is immersed, spilling out to the exterior of the container.

Figure 6:
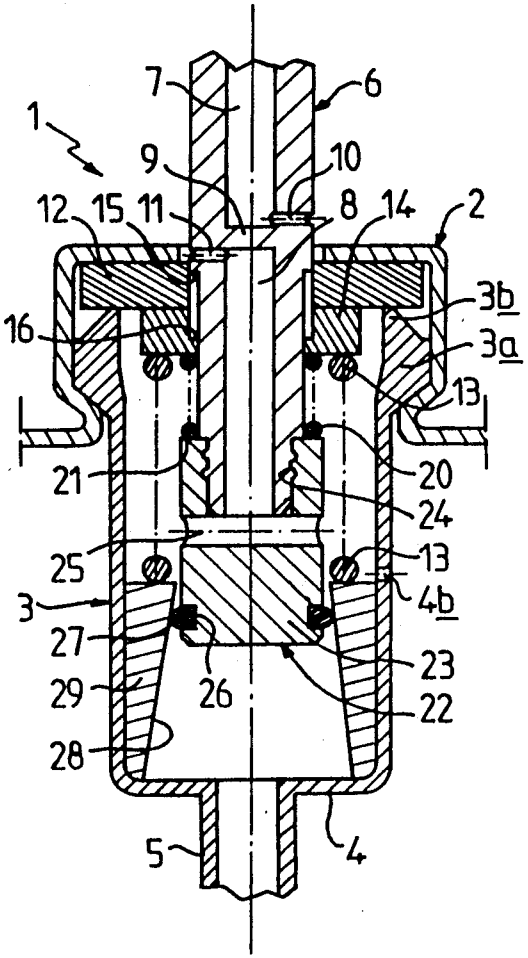
FIG. 6 shows the valve of FIG. 4 in the evacuation position, the stem being moved out.
Figure 5:
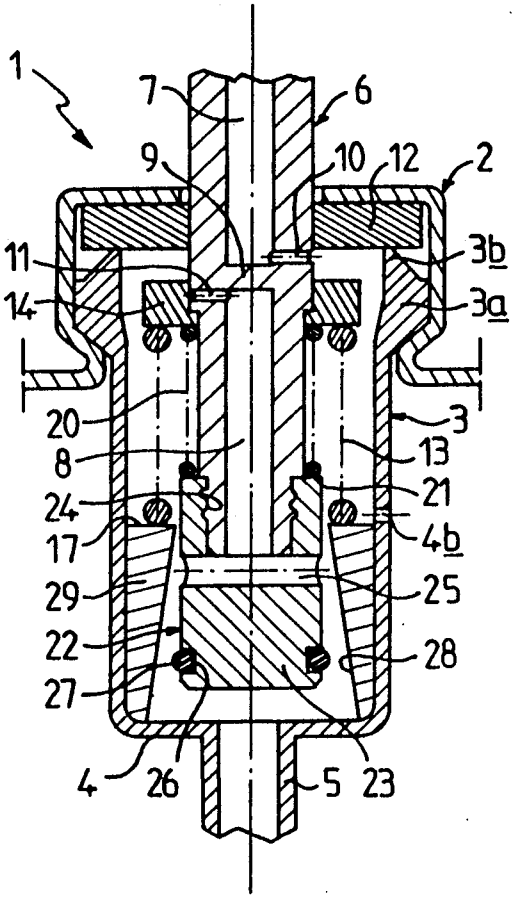
FIG. 5 shows the valve of FIG. 4 in the dispensing position, the stem being pressed, and finally
Figure 4:
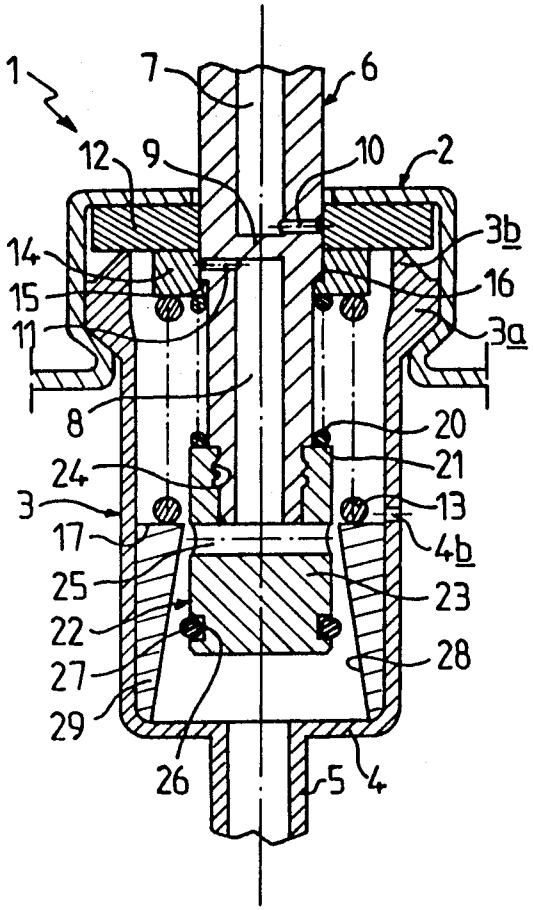
FIG. 4 in a similar manner to that of FIG. 1, shows a variant embodiment of the valve adapted to close a passageway in the event of abnormal excess pressure, the valve being illustrated in the rest position and therefore the closed position in FIG. 4.

The variant embodiment of FIGS. 4 to 6 is provided to guarantee not only that the container will not explode in the event of abnormal excess pressure, but also that only the gaseous phase contained in the container can escape in the event of a problem (the container or can being assumed to be in the vertical position, e.g. on a shelf).

The majority of the elements already described with reference to FIGS. 1 to 3 and reappearing in FIGS. 4 to 6 are designated by the same reference numerals and they are not described again The lower part 22 of the valve stem 6 is adapted to stop communication between the tube fitting 5 (and the dip tube not shown connected to this tube fitting) and the evacuation channel 8 when the stem is raised on account of excess internal pressure in the container.

The lower part 22 consists of an end fitting 23 having an outer diameter greater than that of the spring 20, this end fitting 23 comprising on the side opposite the tube fitting 5 a blind bore 24 comprising a thread into which a thread provided on the outer surface of the end of the stem 6 is screwed.

The shoulder 21 consists of the upper transverse face of the end fitting 23.

A diametrical channel 25 is provided in the end fitting 23 so as to communicate with the base of the bore 24 and to open on either side on to the cylindrical surface of the end fitting 23.

Towards its lower end, the end fitting 23 comprises an annular groove 26 in which a seal 27 consisting of an O-ring, e.g. of elastomeric material, is mounted.

The lower end of the end fitting 23 is adapted to be displaced in a truncated passageway 28, the diameter of which decreases in the direction of outward movement of the stem 6. This passageway 28 is advantageously provided in a sleeve 29 applied to the base 4 of the valve body 3 and the outer cylindrical surface of which follows the contours of the inner surface of the body 3. The upper front end of the sleeve 29 forms the stop 17 for the first spring 13.

The diameter of the large base of the truncated passageway 28 is greater than the outer diameter of the seal 27, while the diameter of the small base (upper base) of the passageway 28 is less than the outer diameter of the seal 27, while being greater than the outer diameter of the end fitting 23.

In the rest position or closed position of the stem 6 illustrated in FIG. 4, the seal 27 is situated substantially half-way up the passageway 28.

The additional gas inlet **4*b* is provided in the cylindrical wall of the body 3 above the stop 17, i.e. above the zone in which sealing is established between the seal 27 and the truncated passageway 28. In this manner, the lower part of the body 3 to which the channel 25** leads will remain in communication with the inner volume of the container.

This being the case, the operation of the valve of FIG. 4 is as follows.

In the rest position according to FIG. 4, or the closed position, the transverse orifice 10 is situated opposite the sealing washer 12. The spring 13 applies the assembly formed by the stem 6, the washer 14, the spring 20, the end fitting 23 and the seal 27 to the inner face of the washer 12.

When a user presses on the stem 6, as illustrated in FIG. 5, the spring 13 is compressed and the upper transverse orifice 10 is released and opens into the interior of the body 3. This allows for communication between the interior of the container and the atmosphere.

The aerosol can then be sprayed, the liquid being propelled through the tube fitting 5 towards the exterior, originating from the dip tube.

FIG. 6 shows the case of a problem with operation on account of abnormal excess pressure in the container, which is assumed to be vertical, e.g. placed on a shelf.

From the rest position illustrated in FIG. 4, if there is an abnormal increase in pressure in the container, the spring 20 is compressed and the stem 6, together with the end fitting 23, is displaced upwards, i.e. it gradually comes out of the cup 2.

As a result of the narrowing of the passageway 28, the seal 27 is applied in a sealed manner to a zone situated towards the upper end of this passageway as illustrated in FIG. 6. The assembly is adapted so that in this position the transverse passageway 11 has traversed the washer 12 and opens into the atmosphere.

Evacuation can then be effected solely through the additional gas inlet **4*b*, the channels 25 and the passageway 11**.

The passageway for the liquid originating from the dip tube through the tube fitting 5 is closed by the seal 27 and the end fitting 23.

In this manner, only the gaseous phase can escape into the atmosphere, this, while still preventing explosion as in the case of the valve of FIG. 1, having the advantage of preventing dispersion of the liquid phase to the exterior.

Irrespective of the solution adopted, the overall axial dimensions of the valve are reduced by the parallel arrangement of the springs. The independent action of these springs allows for precise adjustment of their levels of intervention.

I claim:

1. A control valve for a container containing a fluid under gaseous pressure comprising:

a valve stem moveable in a valve body, said stem having an axis and being provided along said axis with two opposing recessed channels each leading to an opposite end of said valve stem, said channels being separated by a base and said stem having a lateral wall with transverse orifices being located in said lateral wall on opposite sides of said base, each of said orifices communicating respectively with one of said channels, one of said channels being remote from said valve body and forming with said transverse orifice associated therewith a dispensing passageway, the other said channels being associated with the other said transverse orifice which together form an evacuation passageway;

said control valve further including a sealing member having an opening for receiving said valve stem;

a first spring being provided to force said valve stem relative to said valve body in a direction corresponding to an outward movement of said stem relative to said valve body and a second spring disposed so as to prevent outward movement of said stem so long as the pressure in the interior of the container does not exceed a predetermined value, wherein a user by pressing on the stem brings said dispensing passageway into communication with an interior of said valve body to effect the dispensing of the product and that, in the event of abnormal excess pressure, said second spring is compressed to raise said valve stem to bring said evacuation passageway into communication with the atmosphere external to said valve body to prevent the container from exploding and wherein said first and second springs are disposed in parallel with said first spring and second spring having one end each respectively engaging an abutment means, said valve stem having a stop member for engaging said abutment means when said valve stem is moved into said valve body by a user, said abutment means being slidable relative to said valve stem upon outward movement of said valve stem relative to said valve body, said first spring having a second end resting against another stop member disposed in said valve body while said second spring has a second end engaging a stop integral with said valve stem.

2. Valve according to claim 1, characterized in that the first and second springs (13, 20) are helical springs disposed concentrically.

3. Valve according to claim 2, characterized in that the first spring (13) which operates during dispensing is exterior to the second spring (20) and its length is greater than that of the second spring (20), which operates for evacuation in the event of abnormal excess pressure.

4. Valve according to claim 1, characterized in that the stop (17) integral with the valve body (3), serving as a support for the first spring (13), comprises a shoulder projecting radially towards the interior of the valve body.

5. Container containing a fluid under gaseous pressure provided with a control valve according to claim 1.

6. Valve according to claim 1 wherein said abutment means comprises a rigid washer having a central opening for receiving said valve stem with said central opening being provided with a shoulder extending radially inwardly for cooperating with a radial shoulder provided on said stem forming said stop member.

7. The valve as claimed in claim 1 wherein when said valve stem is disposed in a rest position, said evacuation passageway is disposed on the same side of said sealing member as said valve body while said dispensing passageway is closed by said sealing member.

8. The valve as claimed in claim 7 wherein said valve stem is provided with an O-ring and said valve body is provided with a truncated passageway, the diameter of which decreases in the direction of outward movement of said valve stem, said O-ring being provided on one end of said valve stem to cooperate with said truncated passageway so that when said valve stem is displaced relative to said truncated passageway said O-ring will close said truncated passageway when said valve stem is raised, said evacuation passageway extending along said axis of said valve body and having a lateral communication passageway for communicating with the inner volume of said valve body.

9. The valve as claimed in claim 1 wherein said sealing member comprises a washer of elastomeric material having an outer periphery, the valve body including a container having a cup, said valve body having an upper edge with said upper edge holding said outer periphery in said cup.

10. Valve according to claim 1 characterized in that one end of the stem comprises and added member (23) comprising a transverse channel (25), fixed to the part of the stem to which the evacuation passageway leads, said added member having a radial shoulder, the radial shoulder being formed by the thickness of said added member added to the stem forming the stop for the second spring (20) which operates in the event of evacuation.

11. The valve as claimed in claim 1 wherein a container having an upper part is provided and said valve stem has a lower part adapted to stop communication between a tube fitting connected to a dip tube and said evacuation passageway when said valve stem is moved from a rest position to an actuated position resulting from excess internal pressure in the container, said valve body having a sealing zone for said lower part of said stem and including an additional gas inlet disposed above said sealing zone in said valve body to maintain communication between said evacuation passageway and said upper part of the container and to allow for evacuation of gas alone.

* * * * *